US005388537A

United States Patent [19]

Larson et al.

[11] Patent Number: 5,388,537

[45] Date of Patent: Feb. 14, 1995

[54] SYSTEM FOR BURNING REFUSE-DERIVED FUEL

[75] Inventors: Lory E. Larson, Walnut Grove, Calif.; Thomas R. Miles, Portland, Oreg.

[73] Assignee: Southern California Edison Company, Rosemead, Calif.

[21] Appl. No.: 285,332

[22] Filed: Aug. 2, 1994

[51] Int. Cl.[6] ..... F23G 5/00

[52] U.S. Cl. ..... 110/346; 110/110; 110/118; 110/193; 110/255; 110/256; 414/208; 414/218; 414/221

[58] Field of Search ..... 110/346, 101 R, 118, 110/327, 188, 193, 242, 256, 255, 257, 267, 110; 414/160, 200, 208, 218, 221

[56] References Cited

U.S. PATENT DOCUMENTS

| | | | |
|---|---|---|---|
| 2,325,203 | 7/1943 | Hayes | 414/221 X |
| 3,610,182 | 5/1971 | Stockman . | |
| 3,699,905 | 10/1972 | Gach et al. . | |
| 3,777,677 | 12/1973 | Ali et al. . | |
| 4,080,931 | 3/1978 | Northcote et al. . | |
| 4,247,240 | 1/1981 | Schora, Jr. et al. | 414/221 X |
| 4,311,102 | 1/1982 | Kolze et al. . | |
| 4,331,084 | 5/1982 | Fitch et al. . | |
| 4,348,968 | 9/1982 | Demar . | |
| 4,758,118 | 7/1988 | Rachner et al. . | |
| 4,809,667 | 3/1989 | Uranishi et al. . | |
| 4,984,524 | 1/1991 | Mindermann et al. . | |
| 5,022,328 | 1/1991 | Robertson . | |
| 5,175,943 | 1/1993 | Eastham et al. . | |
| 5,195,449 | 3/1993 | Michinae | 110/257 |
| 5,279,235 | 1/1994 | Greco . | |

*Primary Examiner*—Edward G. Favors
*Attorney, Agent, or Firm*—Jeffrey G. Sheldon

[57] ABSTRACT

A system for disposing of refuse-derived fuel ("RDF") and converting the refuse-derived fuel into a fuel gas is described. The system includes a positive pressure combustion chamber and a feed system for feeding the RDF into the combustion chamber at high speed. No compaction of the low density RDF is required. The feed system includes a feed conveyor, first and second air locks with a first conduit between the feed conveyor and the first air lock, and a second conduit between the first and second air locks. Both conduits are generally vertically oriented, but sloped at an angle that prevents bridging of the RDF.

24 Claims, 3 Drawing Sheets

SYSTEM FOR BURNING REFUSE-DERIVED FUEL

BACKGROUND

In the last century, much of the world's energy needs have been filled by hydrocarbon fuels which provided a convenient, plentiful, and inexpensive energy source. However, as reserves of hydrocarbon fuels such as coal and oil are used, their supply becomes less certain and their cost increases. Thus, there has been intense investigation of alternative sources of energy.

Another problem of modern society, in addition to reduced resources of hydrocarbon energy supplies, is increasing waste disposal problems. In parts of the United States, suitable locations for disposing of solid waste are in short supply, requiring solid waste to be transported to distant locations. Moreover, disposal of solid waste can create pollution problems, such as contamination of ground water.

An example of where solid waste disposal is fast becoming a significant problem is the situation in Southern California. About 50,000 tons of refuse are generated daily in Los Angeles County alone. Landfill capacity close to the source of waste generation is being exhausted, and new capacity is difficult to obtain due to public opposition and regulatory constraints. These factors are exerting enormous pressure to reduce landfill use and are forcing landfills to be located near remote areas, necessitating significant transportation expense. Further, transportation of large quantities of refuse to distant locations requires energy consumption, exacerbating the problem of reduced hydrocarbon energy supplies.

There have been attempts made to reclaim and recycle solid waste, where portions of the solid waste, namely refuse-derived fuel ("RDF"), are burned to produce energy, thereby helping to solve the problem of reduced energy supplies. A significant problem with this approach is that the refuse-derived fuel, which comprises plastic and paper, is of low bulk density, typically five to ten pounds per cubic foot. Because of this low bulk density, RDF is very difficult to feed to a combustion system. To overcome this problem, the RDF is compressed and pelletized. However, the energy costs associated with compressing the RDF significantly offsets the energy gained by burning the RDF, and in some instances, can render the process uneconomical.

Accordingly, there is a need for a system for combusting refuse-derived fuel and recovering energy from the combustion, where it is not necessary to compress the RDF prior to combustion.

SUMMARY

We have developed a system that meets this need in that it is able to feed refuse-derived fuel, without prior compaction of the fuel, into a positive pressure combustion chamber containing combustious gases. The system comprises first and second air locks to separate the RDF, which is stored at atmospheric pressure, from the combustion chamber, which is at positive pressure. A feed conveyor conveys the RDF, through a first conduit to the first air lock, and a second conduit transports the RDF from the first vaned air lock to the second vaned air lock. Another conveyor is used for transporting the RDF from the second air lock to the combustion chamber.

Both conduits are generally vertically oriented to avoid bridging of the refuse-derived fuel. However, the first air lock is offset from the discharge of the feed conveyor, and the second air lock is offset from the first air lock so that the two conduits slope at a sufficient angle from vertical to properly feed the air locks. The angle is at least 55°, typically from about 55° to about 70°, and preferably from about 55° to about 65° from horizontal.

The combination of two air locks, and the appropriately sloping conduits, allows low density RDF, stored at atmospheric pressure, to be fed into a positive pressure combustion chamber, without the need for prior compaction.

Preferably the combustion chamber operates at less than stoichiometric amounts of oxygen so that the fuel is gasified to produce a fuel gas containing hydrogen and carbon monoxide. To prevent backflow of combustion gases into the combustion chamber, and the resulting explosion risk, preferably a substantially oxygen-free purge gas, such as nitrogen or flue gas, is introduced into the second conduit between the two air locks.

To avoid charring of the fuel, which can plug up the feed system, preferably the RDF is fed into the combustion chamber at high speed, such as with a screw conveyor operating at at least 50 feet per minute.

For safety purposes, the system can include a sensor for detecting the combustion gas content of the system upstream of the combustion chamber. A carbon dioxide, carbon monoxide and/or hydrogen sensor, can be used for this purpose. A positive displacement metering pump with a variable speed drive can be used for regulating the amount of purge gas introduced dependent upon the sensor readings.

DRAWINGS

These and other features, aspects, and advantages of the present invention will become better understood with reference to the following description, appended claims, and accompanying drawings where:

FIG. 2A shows a receiving system and a portion of the feed system, and FIG. 2B shows the remainder of the system;

DESCRIPTION

Figure 1:
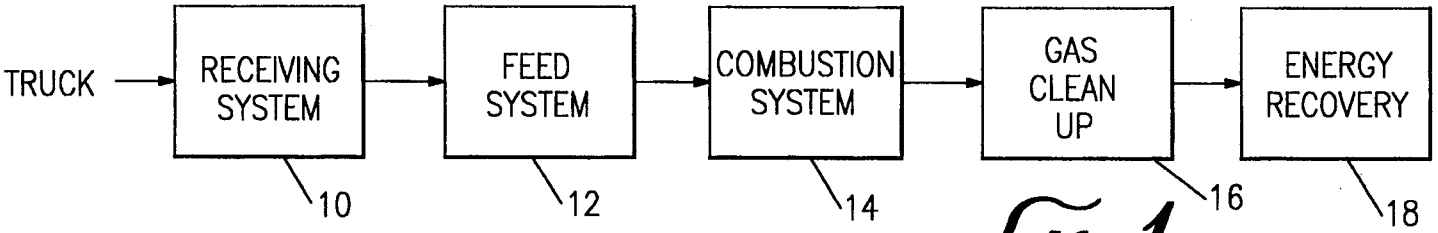
FIG. 1 is a block diagram showing the major elements of a system for processing refuse-derived fuel according to the present invention.

The present invention is directed to a system for not only disposing of refuse-derived fuel, but also effectively and efficiently recovering energy from the RDF. With reference to FIG. 1, the system comprises as its main process units, starting at the beginning of the process, a receiving system 10, a feed system 12, a combustion system 14 having a combustion chamber 15, a gas cleanup unit 16, and an energy recovery unit 18. The system shown in the drawings has a capacity of about six tons per hour of refused-derived fuel 19. The refuse-derived fuel has a bulk density of less than 12 pounds per cubic foot, and typically about 5 to about 10 pounds per cubic foot. For the design plan, it is assumed that the RDF has a bulk density of about 8 pounds per cubic foot.

Receiving System and Feed System

Figure 2A:
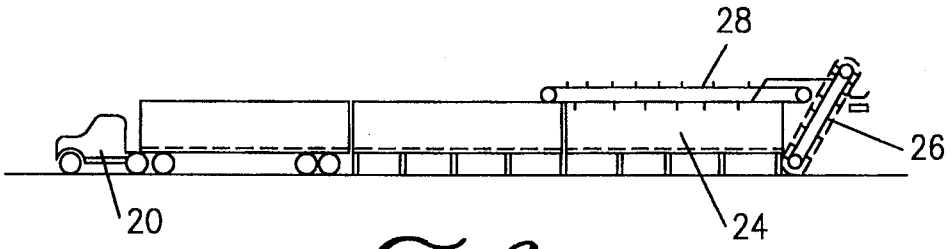
FIGS. 2A and 2B are front elevation views of a system according to the present invention, where
Figure 3:
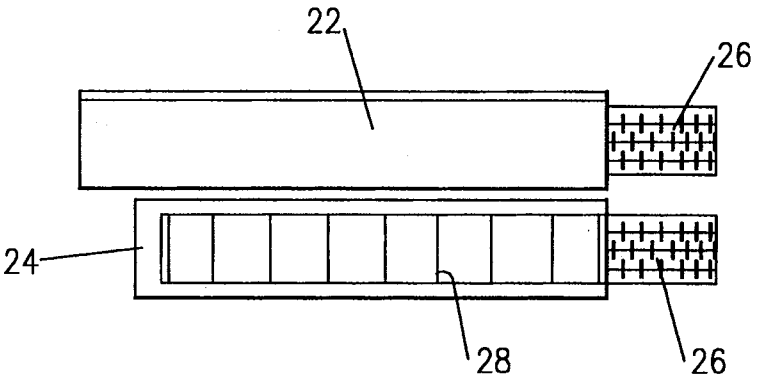
FIG. 3 is a top plan view of a portion of the system shown in FIG. 2A.

With reference to FIGS. 2A and 3, the receiving system 10 and the beginning of the feed system 12 are shown. RDF is delivered for processing, such as by trucks 20, and can be placed directly on a horizontal collection conveyor 22 or into a moving floor storage bin 24. RDF is removed from the collection conveyor 22 or the storage bin 24 by respective metering elevators 26, that are preferably chain-staged units. Excess RDF is transferred from each metering elevator 26 by a respective chain rake-back 28.

Figure 2B:
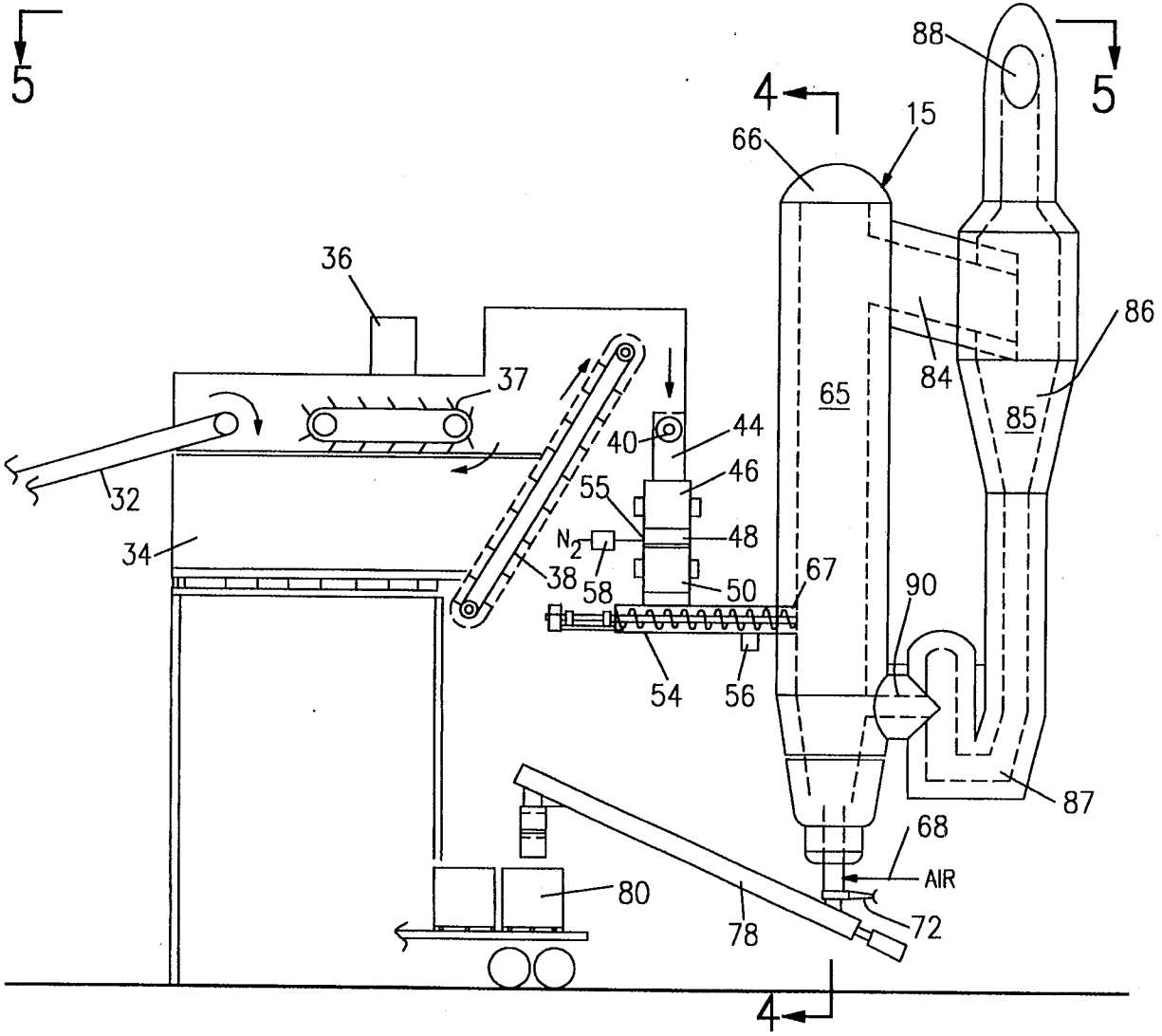
Figure 5:
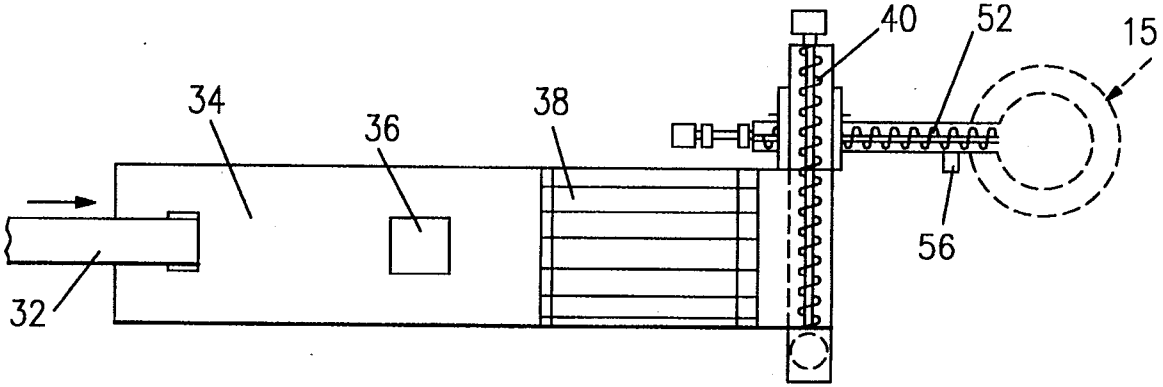
FIG. 5 is a top plan view of a portion of the system, taken on line 5—5 in FIG. 2B.

With reference to FIGS. 2B and 5, the RDF is transported by a conveyor 32 upwardly from the elevator 26 and deposited into a feed bin 34 provided with a filter vent 36 and a rake back 37. The feed bin 34 is sized to provide about 45 minutes worth of RDF, and preferably has a moving floor powered by a seven-and-a-half horse power hydraulic unit, i.e., the bin is a live-bottom, moving floor bin of the type discussed in U.S. Pat. No. 4,143,760. Moving floor bins are available from Hallco of Tillamook, Ore. The moving floor of the bin 34 carries the RDF to a variable staggered flight conveyor 38 which serves as the primary control for the rate at which RDF is processed through the system. From the flight conveyor 38, RDF is carried by a first upper screw feeder or auger 40 (FIG. 5) driven by a motor 42, to a first vertically-oriented, sloping conduit 44 that is connected to the discharge end of the upper screw feeder 40. The discharge end of the conduit 44 discharges the RDF into a first rotary vane air lock 46. From the upper first air lock 46, the RDF is transported via a second, sloping, generally vertically oriented conduit 48 into a second rotary vane air lock 50. The two air locks 46 and 50, in combination, separate the atmospheric pressure side of the system, namely the conveyor system, from the relatively high pressure, or positive pressure portion of the system, which includes the combustion system 14.

Suitable air locks 46 and 50 can be obtained from Rader Company of Portland, Ore., are typically 30 by 35 inches, and operate at about 15 RPM.

Each air lock 46, 50 comprises a housing 51*a* containing rotating, spaced apart vanes 51*b* with fuel receiving and transporting cavities 51*c*′ therebetween. A trailing cavity 51*c*′ and a leading cavity 51*c*″ are exposed to fuel in the conduit leading into the air lock. The housing 51*a* is provided with an access door 51*d*. A knife 51*e* prevents the fuel from overflowing out of the cavities 51*c*. A rubber belting baffle 51*f* guides the RDF 19 into the trailing cavity 51*c*′.

To avoid bridging of the RDF, which is a significant problem in transporting RDF, preferably the two conduits 44 and 48 are sloped at an angle of at least 55° from horizontal to avoid bridging of the fuel. Preferably, the angle 53 is less than 70°, and more preferably less than 65°, and optimally at about 60° to uniformly feed the air locks. The preferred angles are from 55° to 65°.

As the last unit of the feed system 12, there is provided a second, lower screw feed conveyor 54 which transports the RDF into the combustion system. The second screw conveyor 52 operates at about the same pressure as the pressure in the combustion chamber 15 of the combustion system 14. The screw conveyor 54 provides high speed injection of the RDF 19 into the combustion chamber 15 to avoid charring and precombustion of the RDF, which can plug up the system. Preferably the feed rate is at least 50 feet per minute, such as at about 70 feet per minute. A screw with a 12 inch pitch turning at 70 RPM provides a feed rate of 70 feet per minute.

Figure 4:
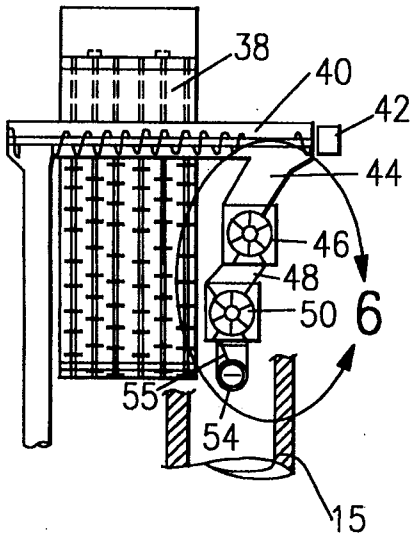
FIG. 4 is a side elevation view, partly in section, of a portion of the system taken on line 4—4 in FIG. 2B.
Figure 6:
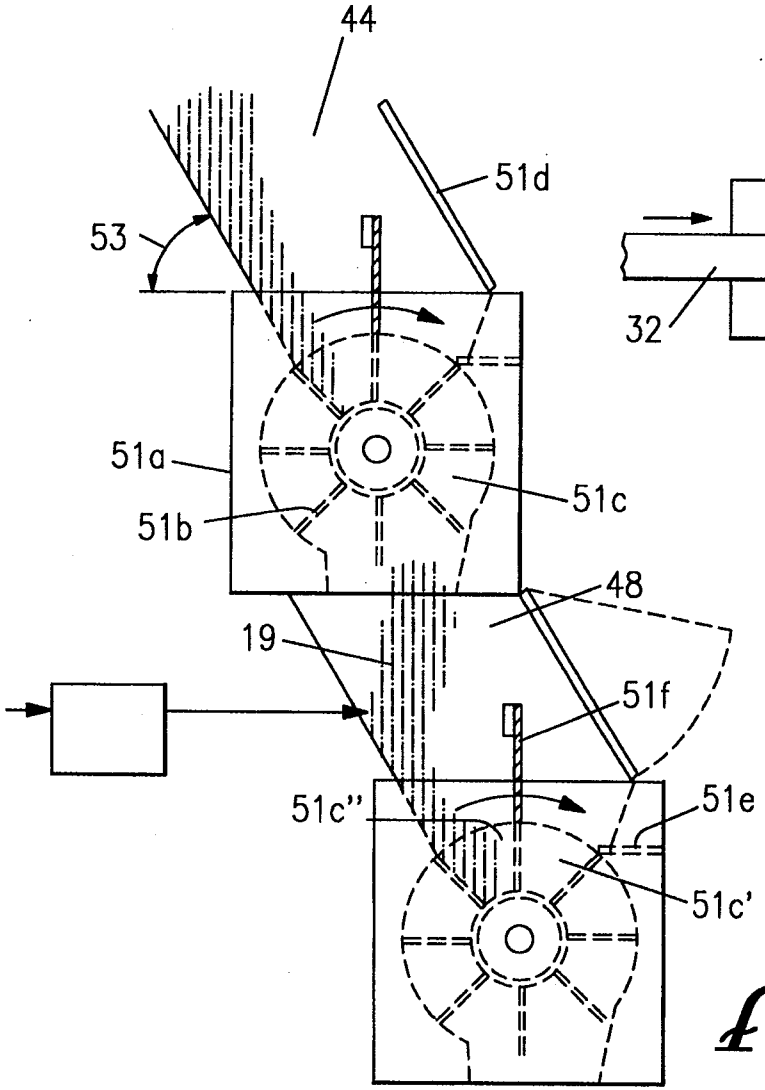
FIG. 6 is a detailed view of the region 6 in FIG. 4.

As shown in FIG. 4, the inlet to the screw conveyor 54 is preferably provided with a baffle or deflector plate 55 to prevent RDF from fall into the leading side of the screw and being jammed against the walls of the conduit 48, thereby jamming the screw conveyor 54 and causing downtime.

To prevent backflow of the potentially explosive combustion gases from the combustion system, preferably a substantially oxygen-free purge gas is introduced into the feed system to prevent backflow. Preferably the purge gas is nitrogen, but other gases can be used, such as carbon dioxide, helium, flue gas, and oxygen-free air. The best location for introduction of the purge gas is through an inlet 55 into the conduit 48 between the two air locks 46 and 50.

The combination of the rotary valve air locks 46, 50, and nitrogen purge protects the system from explosive hot combustion gases backing up into the portion of the feed system that is at atmospheric pressure and exposed to oxygen.

A sensor 56 can be provided in the feed system, such as at the second screw feeder 52, or alternatively at the lower second air lock 50, or both, to detect for combustion gases. The sensor can be sensitive to carbon dioxide, carbon monoxide, and/or the hydrogen content, or the temperature of the gas present at the sensor. The sensor 56 can be connected to an alarm (not shown) to alert operators if excessively high levels of combustion gas are detected, indicating a dangerous situation where high temperature, combustible combustion gases could possibly be exposed to atmospheric air. Further, the sensor 56 can be connected to a speed controller of a positive displacement purge gas metering pump 58 in the nitrogen feed line 54 for regulating the amount of purge gas, thereby increasing or decreasing the flow of purge gas. Alternatively, high pressure purge gas can be obtained, and a control valve can be used to control the rate at which the purge gas is fed. If excessively high levels of combustion gas are detected, the amount of purge gas fed can be increased to force the combustion gas back into the combustion chamber 64. The metering pump 58 can be operated to minimize the amount of purge gas, subject to having too much backflow of combustion gas. The less nitrogen purge gas used, the greater the heating value of the gas produced in the combustion chamber.

Combustion System

The combustion system 14 can be any type of system effective for burning RDF and recovering heating value from the RDF. However, one of the goals of the present invention is to be able to recover energy from RDF, with substantially no pollution generated. For this purpose, preferably as a combustion chamber 15 there is used a fluidized bed gasifier operated at sub-stoichiometric conditions. As best shown in FIG. 2B, the combustion chamber 15, which contains a combustion zone 65, is an elongated, vertically-oriented, generally cylindrical tower where the RDF is fed into the bottom portion of the tower through a solid feed inlet 67. A blower or compressor (not shown) is used to pressurize the feed gas and nozzles (not shown) are used to obtain the requisite fluidization velocity. Oxygen containing feed gas is fed through a gas inlet 68 into the bottom of the tower 15 at a sufficiently high velocity and in a sufficient quantity to fluidize the solids in the tower. The oxygen-containing gas can be air, or other gases such as oxygen-enriched air, oxygen-depleted air, or pure oxygen.

Preferably the combustion zone 65 is air starved, operating at about 20 to 25 percent of stoichiometric, so that the gas produced in the combustion zone 65 is a combustible fluid gas, having significant fuel value in the form of carbon monoxide, hydrogen, and nitrogen. Operating the process under these conditions produces a solid ash that contains about five percent carbon. The ash collects at the bottom of the chamber, from where it can be removed through a valve 72 onto a conveyor 78 to be dumped into bins 80 for disposal. A preferred disposal of the ash is mixing it into cement to form concrete, the carbon content of the ash lending itself to be particularly suitable for this purpose.

The gas in the combustion zone contains primarily carbon monoxide, hydrogen, and nitrogen, but in addition, some carbon dioxide, hydrogen sulfide and other sulphur-containing compounds, ammonia, and entrained particulates. This gas passes out of the fluidized bed combustion chamber 15 through an upper discharge outlet conduit 84 to the gas cleanup system 16.

Gas Cleanup System

The gas cleanup system 16 starts with a particulate removal zone 85, which is preferably a recycle cyclone 86. In the cyclone 86, ash and other particulates fall to the bottom and are recycled back into the bottom of the combustion chamber 15 through a venturi-shaped conduit 90. As shown in FIG. 5, preferably the bottom 87 of the cyclone 86 is generally U-shaped, thereby forming a trap containing particulates that prevent air and combustion gases in the combustion zone 65 from passing into the bottom of the cyclone 86. Gas from the top of the cyclone passes through an outlet 88 into other alternative gas cleanup units.

The alternate cleanup units can include, for example, sequentially, a second cyclone, an aerosol scrubber, a venturi scrubber, and a centrifugal separator. These additional units remove additional particulates and contaminates such as hydrogen sulfide and ammonia. In addition, filters, such as silicon carbide filters from Westinghouse, can be used for removal of aerosols, tars, and particulate

Energy Recovery

The clean fuel gas product from the gas cleanup unit is suitable for combustion to create useful energy. The energy content of the clean fuel gas can be used such as by burning the fuel gas to generate steam, which can be used directly, or which can be used to generate electricity in the energy recovery zone 18.

While the present invention has been described in considerable detail with reference to certain preferred versions thereof, other versions are possible. Therefore, the spirit and scope of the dependent claims should not be limited to the description the preferred versions contain.

We claim:

1. A system for continuously feeding refuse-derived fuel into a positive pressure combustion chamber, the system comprising:

a) a first, rotary vane air lock;

b) a feed conveyor at substantially atmospheric pressure for transporting refuse-derived fuel having a bulk density of less than 12 pounds per cubic foot from a feed source to the first air lock, the feed conveyor system having a discharge at an elevation above the elevation of the first air lock;

c) a second, rotary vane air lock below the first air lock for receiving the refuse derived fuel from the first air lock;

d) a combustion chamber feeder for feeding the refuse derived fuel from the second air lock into a combustion chamber that is at a positive pressure;

e) a generally vertical, first conduit from the feed conveyor to the first air lock; and f) a generally vertical, second conduit from the first air lock to the second air lock, wherein the first air lock is offset from the discharge of the feed conveyor and the second air lock is offset from the first air lock so that the two conduits slope at a sufficient angle from horizontal to avoid bridging of the refuse-derived fuel and to properly feed the vanes of the air locks.

2. The system of claim 1 wherein the conduits slope at an angle of from 55° to 70° from horizontal.

3. The system of claim 2 wherein the conduits slope at an angle of from 55° to 65° from horizontal.

4. The method of claim 3 wherein the conduits slope at an angle of about 60° from horizontal.

5. The system of claim 1 including a conduit for introducing a substantially oxygen free purge gas into the second conduit for preventing combustion gases in the combustion chamber from passing into the air locks.

6. The system of claim 5 including a sensor for detecting the combustion gas content of the system upstream of the combustion chamber.

7. The system of claim 6 including a controller for controlling the amount of purge gas introduced into the second conduit as a function of the gas content detected by the sensor for minimizing the amount of purge gas that enters the combustion chamber.

8. The system of claim 1 including a screw conveyor for receiving refuse-derived fuel from the second air lock and feeding the refuse-derived fuel into the combustion chamber at a speed of at least 50 feet per minute.

9. The system of claim 1 including a screw conveyor for receiving refuse-derived fuel from the second air lock and feeding the refuse-derived fuel into the combustion chamber at a speed of about 70 feet per minute.

10. A method for combusting refuse-derived fuel in a positive pressure combustion zone, the method comprising the steps of:

a) conveying from a feed source refuse-derived fuel having a bulk density of less than 12 pounds per cubic foot on a feed conveyor having a discharge;

b) transporting downwardly, at substantially atmospheric pressure, the refuse-derived fuel from the discharge of the feed conveyor to a first air lock through a first, generally vertical conduit;

c) transporting downwardly the refuse-derived fuel from the first air lock to a second air lock through a second, generally vertical conduit;

wherein the first air lock is offset from the discharge of the feed conveyor and the second air lock is offset from the first air lock so that the two conduits slope at a sufficient angle from vertical to avoid bridging of the refuse-derived fuel and to feed the valves; and d) transporting the refuse-derived fuel from the second air lock to a positive pressure combustion zone; and e) combusting the refuse-derived fuel in the combustion zone while maintaining the combustion zone at a pressure greater than atmospheric pressure, thereby generating combustion gases.

11. The method of claim 10 wherein the conduits slope at an angle of from 55° to 70° from horizontal.

12. The method of claim 11 wherein the conduits slope at an angle of 55° to 65° from horizontal.

13. The method of claim 12 wherein the conduits slope at an angle of about 65° from horizontal.

14. The method of claim 10 including the step of introducing a substantially oxygen free purge gas into the second conduit for preventing combustion gases in the combustion zone from passing into the air locks.

15. The method of claim 14 including the step of detecting combustion gas content upstream of the combustion zone.

16. The method of claim 15 including the step of controlling the amount of purge gas introduced into the second conduit as a function of the gas content detected by the sensor for minimizing the amount of purge gas that enters the combustion zone.

17. The method of claim 10 wherein the step of transporting the refuse-derived fuel to the combustion zone comprises feeding the refuse-derived fuel into the combustion zone at a sufficiently high speed of at least 50 feet per minute to avoid charring of the fuel before the fuel enters the combustion zone.

18. The method of claim 17 wherein the refuse-derived fuel is fed into the combustion zone with a screw conveyor.

19. The method of claim 17 wherein the step of transporting the refuse-derived fuel to the combustion zone comprises feeding the refuse-derived fuel into the combustion zone at a speed of about 70 feet per minute.

20. A method for combusting refuse-derived fuel in a positive pressure combustion zone, the method comprising the steps of:

a) conveying from a feed source refuse-derived fuel having a bulk density of less than 12 pounds per cubic foot to a positive pressure combustion zone;

b) feeding the refuse-derived fuel into the combustion zone at a sufficiently high speed to avoid charring of the fuel before the fuel is introduced into the combustion zone; and c) combusting the refuse-derived fuel in the combustion zone while maintaining the combustion zone at a pressure greater than atmospheric pressure.

21. The method of claim 20 wherein the refuse-derived fuel is fed into the combustion zone with a screw conveyor.

22. A method for combusting refuse-derived fuel in a positive pressure combustion zone, the method comprising the steps of:

a) conveying from a feed source refuse-derived fuel having a bulk density of less than 12 pounds per cubic foot to a positive pressure combustion zone;

b) feeding the refuse-derived fuel into the combustion zone at a speed of at least 50 feet per minute; and c) combusting the refuse-derived fuel in the combustion zone while maintaining the combustion zone at a pressure greater than atmospheric pressure.

23. The method of claim 22 wherein the step of feeding the refuse-derived fuel into the combustion zone comprises feeding the refuse-derived fuel into the combustion zone with a screw conveyor.

24. The method of claim 22 wherein the step of feeding the refuse-derived fuel into the combustion zone comprises feeding the refuse-derived fuel into the combustion zone at a speed of about 70 feet per minute.

* * * * *